US006772716B2

(12) United States Patent
Chekaiban et al.

(10) Patent No.: US 6,772,716 B2
(45) Date of Patent: Aug. 10, 2004

(54) METHOD AND SYSTEM FOR CONTROLLING A COOLING SYSTEM OF AN INTERNAL-COMBUSTION ENGINE

(75) Inventors: Georg Chekaiban, Wolnzach (DE); Ulrich Hess, Warngau (DE); Wolfram Enke, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 10/285,671

(22) Filed: Nov. 1, 2002

(65) Prior Publication Data

US 2003/0113213 A1 Jun. 19, 2003

(30) Foreign Application Priority Data

Nov. 2, 2001 (DE) ..... 101 54 091

(51) Int. Cl.[7] ..... F01P 5/10
(52) U.S. Cl. ..... 123/41.44
(58) Field of Search ..... 123/41.44

(56) References Cited

U.S. PATENT DOCUMENTS

| | | | | | |
|---|---|---|---|---|---|
| 3,924,598 | A | * | 12/1975 | Davis | 123/306 |
| 4,423,705 | A | * | 1/1984 | Morita et al. | 123/41.44 |
| 4,475,485 | A | * | 10/1984 | Sakakibara et al. | 123/41.44 |
| 4,580,531 | A | * | 4/1986 | N'Guyen | 123/41.44 |
| 4,706,615 | A | * | 11/1987 | Scadding | 123/41.01 |
| 4,768,484 | A | * | 9/1988 | Scarselletta | 123/41.44 |
| 5,079,488 | A | * | 1/1992 | Harms et al. | 123/41.44 |
| 5,927,953 | A | * | 7/1999 | Marietti | 123/41.44 |
| 6,178,928 | B1 | * | 1/2001 | Corriveau | 123/41.44 |
| 6,352,055 | B1 | * | 3/2002 | Algrain et al. | 123/41.44 |
| 6,425,353 | B1 | * | 7/2002 | Davies | 123/41.44 |
| 6,601,545 | B1 | * | 8/2003 | Hohl | 123/41.31 |
| 2001/0017110 | A1 | | 8/2001 | Ap et al. | |

FOREIGN PATENT DOCUMENTS

| | | | | | |
|---|---|---|---|---|---|
| DE | 4109498 | A1 | | 9/1992 | |
| DE | 3810174 | C2 | | 9/1996 | |
| DE | 19939138 | A1 | * | 2/2001 | F01P/7/16 |
| DE | 10056155 | A1 | | 6/2001 | |
| DE | 69801876 | T2 | | 4/2002 | |
| DE | 69804550 | T2 | | 8/2002 | |
| JP | 57173521 | A | | 10/1982 | |
| JP | 05179948 | A | | 7/1993 | |
| JP | 09105329 | A | * | 4/1997 | F01P/7/14 |
| JP | 2001041040 | A | | 2/2001 | |

* cited by examiner

*Primary Examiner*—Noah P. Kamen
(74) *Attorney, Agent, or Firm*—Crowell & Moring LLP

(57) ABSTRACT

According to a method and a system for controlling a cooling system of an internal-combustion engine, the capacity of a coolant pump is controllable as a function of a fuel quantity fed to the internal-combustion engine.

22 Claims, 1 Drawing Sheet

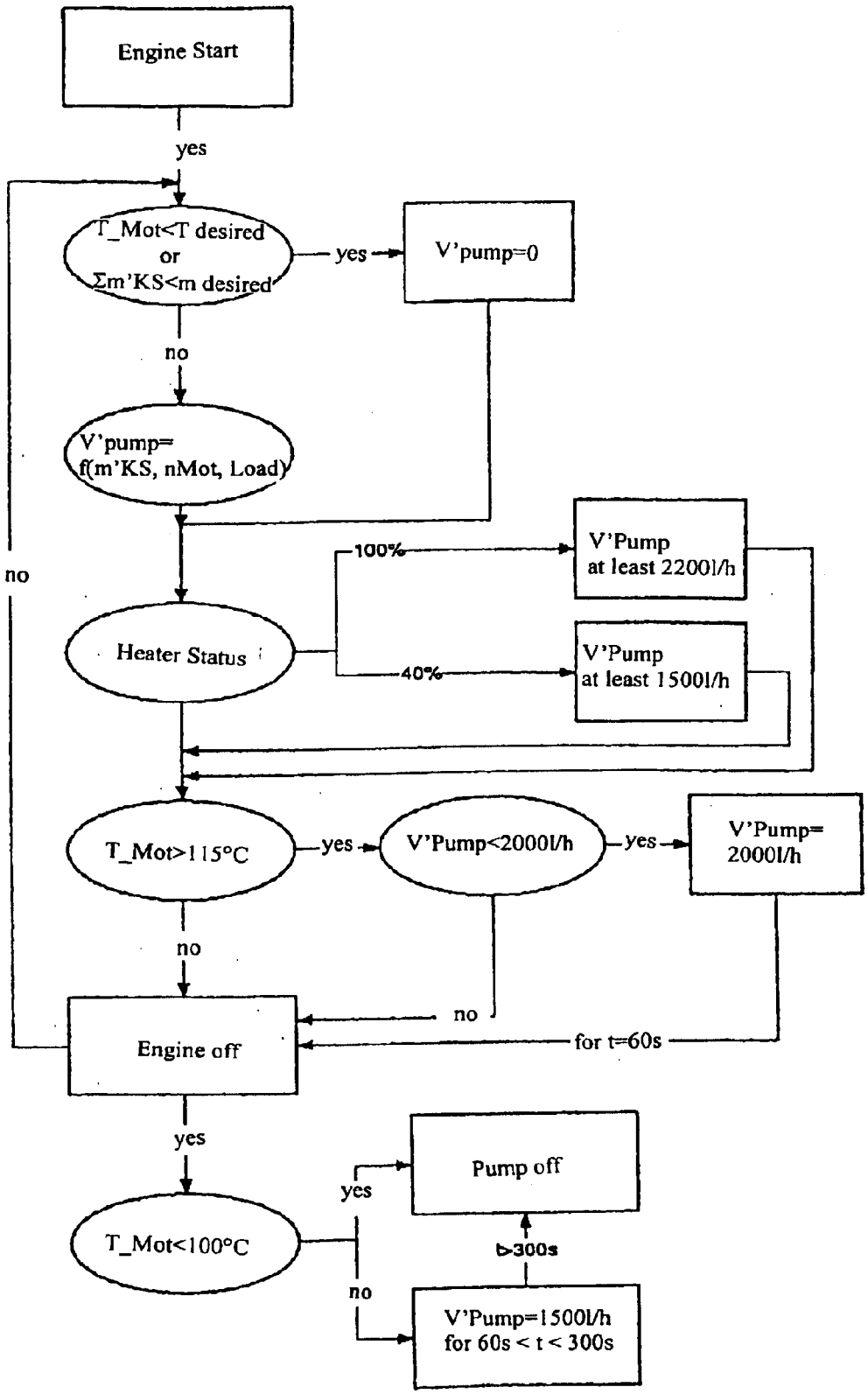
Engine Start
yes
T_Mot<T desired
or
Σm'KS<m desired
yes
V'pump=0
no
V'pump=
f(m'KS, nMot, Load)
no
100%
V'Pump
at least 2200l/h
Heater Status
40%
V'Pump
at least 1500l/h
T_Mot>115°C
yes
V'Pump<2000l/h
yes
V'Pump=
2000l/h
no
no
Engine off
for t=60s
yes
Pump off
yes
T_Mot<100°C
t>300s
no
V'Pump=1500l/h
for 60s < t < 300s

METHOD AND SYSTEM FOR CONTROLLING A COOLING SYSTEM OF AN INTERNAL-COMBUSTION ENGINE

This application claims the priority of German application 101 54 091.4, filed Nov. 2, 2001, the disclosure of which is expressly incorporated by reference herein.

BACKGROUND AND SUMMARY OF THE INVENTION

The present invention relates to a method and a system for controlling a cooling system of an internal-combustion engine, also referred to as an engine in the following.

Such a cooling system includes a coolant pump which guides coolant through an internal-combustion engine in order to cool the latter.

It is known that a coolant pump can be connected, for example by way of a V-belt, with the crankshaft of an internal-combustion engine so that the pump is driven along with engine operation.

Furthermore, a method is known from German Patent Document DE 195 08 104 C2 for controlling a cooling circuit of an internal-combustion engine in which a differentiation is made between a warm-up phase, an operating phase and after running. The warm-up and operating phases, when the engine is started, are determined by the coolant temperature at the engine exit, which is compared with a coolant temperature limit value for the warm-up phase. When the coolant temperature falls below that value, the warm-up phase is recognized. When that value is reached or exceeded, the operating phase is recognized. In the warm-up phase, the engine is at first not cooled as long as it has not reached a coolant starting temperature. After this starting temperature has been reached, however, an air flow generated by a fan, which is guided through a radiator module, and the coolant flow generated by the coolant pump are controlled as a function of a desired difference temperature value of the coolant between the engine inlet and exit. An actual difference temperature value required for the control is determined by way of the heat flow from the internal-combustion engine into the coolant. The heat flow, in turn, is calculated from the momentary coolant flow, the momentary engine load and the rotational engine speed. In this case, the rotational speed of the coolant pump changes with the change of the heat flow, so that brief engine load or rotational speed changes do not affect the operation of the coolant pump. As soon as the temperature limit value for the warm-up phase has been reached, the so-called operating phase will start. During this operating phase, control of the coolant pump and of the fan takes place as a function of the desired difference temperature value and of a desired temperature value of the coolant at the engine exit. The desired temperature value is determined by way of a corresponding characteristic diagram for a defined engine temperature. In the after running phase, in which the engine is switched off, the engine continues to be cooled if the coolant temperature exceeds a predetermined temperature limit value. This method has the disadvantage that the temperature or the difference between various temperatures in the cooling system is used as the control value. Such temperatures in the cooling circuit are slow and, lastly, are only effects of the engine or vehicle operating point.

In European Patent Document EP 0 952 315 A1, a control system for minimizing consumption of electric energy in a cooling system of an internal-combustion engine is disclosed. Based on the engine temperature, vehicle speed and ambient temperature detected by sensors, a control unit controls a fan and an electric pump for cooling the internal-combustion engine. By way of the values detected by the sensors, an operating point is determined by using a characteristic diagram in order to discharge a certain amount of thermal energy from the engine which indicates an optimal ratio from the sum of the energy fed to the fan and the pump. The control system has the disadvantage that several sensors are required in order to detect certain parameters as a function of which the engine is cooled. In addition to the costs which are connected with each individual sensor, there is also the risk of a breakdown of the latter. Likewise, in the case of temperature measuring points, the measuring precision may be reduced by external influences, and a control on the basis of the temperature is therefore limited.

It is an object of the invention to provide a method and a system for controlling a cooling system of an internal-combustion engine in which reliable cooling is permitted.

According to the invention, this object is achieved by a method for controlling a cooling system of an internal-combustion engine including controlling a capacity of a coolant pump as function of a fuel quantity fed to the internal-combustion engine. This object is also achieved by a system for controlling a cooling system of an internal-combustion engine having a coolant pump including a control device which controls a capacity of a coolant pump as a function of a fuel quantity fed to the internal-combustion engine.

One idea of the invention is the idea of variably controlling the cooling system and the variably drivable coolant pump connected therewith as a function of a fuel quantity supplied to the engine. The capacity of the coolant pump can be adjusted over a range of from preferably zero to a maximal pumping capacity (l/h), either continuously or variably, in a plurality of steps. Since the quantity of fuel supplied to the internal-combustion engine is related to heating of the engine, control of the coolant pump, and thus cooling of the engine, can take place in a foreseen manner on the basis of the actually consumed fuel. The relationship of engine heat feeding into the coolant to the fuel mass flow is largely similar for all combustion concepts. This has the advantage that the cooling system or the coolant pump can be controlled according to originator quantities and not solely, as is known, by temperatures in the cooling circuit which are slow and, in addition, are only the effects of an engine or vehicle operating point. Another advantage is that a cooling control is basically possible without sensors or temperature measuring points which are susceptible to disturbances, and these sensors or temperature measuring points, as required, are used only in warm-up, hot idling or hot shut-off operating situations.

Advantageous developments are reflected in certain claims.

According to a preferred embodiment of the invention, the sum of the fed fuel quantity since the ignition of the engine $\Sigma m'_{KS}$ is compared with a so-called desired fuel quantity $m_{desired}$. If the fed fuel quantity falls below the desired value, as occurs, for example, during a cold start of the engine, at first, cooling of the engine by the cooling system does not take place, unless by way of a volume flow demanded for other needs in the cooling system, for example, for a heater. This has the advantage that the warm-up phase of the engine can be shortened and the fuel consumption can be reduced as compared to engines in which the coolant pump is connected with the crankshaft. In the case of these engines, the coolant pump is automatically driven with the starting of the engine, so that the engine is cooled before it is warmed up.

If the sum of the fed fuel quantity $\Sigma m'_{KS}$ exceeds the given desired value $m_{desired}$, cooling takes place by switching the coolant pump on. In this case, the capacity of the coolant pump is determined as a function of at least one parameter, such as the rotational engine speed nMot, the engine load, the outside temperature and/or an average value for a predetermined time interval (for example, 30 seconds) of the fuel quantity $m'_{KS}$. By way of a time-related averaging of the coolant pump rotational speed, compressive pulsating stress can be avoided. This leads to lower stressing of the cooling system and the water or other coolant pump.

Preferably, the cooling system and the coolant pump are additionally controlled as a function of the coolant temperature. For this purpose, in addition to the comparison of the fed fuel quantity, the momentary temperature of the coolant $T_{Mot}$ is compared with a desired coolant temperature $T_{desired}$. If the desired value $T_{desired}$ is exceeded, cooling of the engine by the cooling system takes place, in which case the capacity of the coolant pump, as described above, can be determined as a function of the rotational engine speed nMot, the engine load, the outside temperature and/or the average value of the fuel quantity $m'_{KS}$. This has the advantage that the operating point of the coolant pump can furthermore be variably adapted as a function of defined parameters, such as the outside temperature or the load. This operation is particularly advantageous during hot idling and hot shut-off of the engine.

In addition or as an alternative, the cooling system and the coolant pump can be controlled as a function of the engine oil temperature. For this purpose, in addition to the comparison of the fed fuel quantity, the coolant temperature, the momentary engine oil temperature $T_{oil}$, is compared with a desired engine oil temperature $T_{desired}$. When the momentary engine oil temperature falls below the desired value $T_{desired}$, cooling by the coolant pump does not take place, unless by way of a volume flow demanded for other requirements in the cooling system, for example, for a heater. Furthermore, the cooling starts as soon as the desired engine oil temperature $T_{desired}$ is exceeded. In this case, the capacity of the coolant pump is determined as a function of the rotational engine speed nMot, the engine load, the outside temperature and/or an average value of the fuel quantity $m'_{KS}$.

In addition to the coolant pump, the operation of additional devices, such as an air conditioner, a separate heater or an automatic transmission, also withdraws heat from and/or feeds heat to the engine. Consequently, control of the cooling system preferably additionally takes place as a function of the connecting or the heat feeding of such a device. Here, the capacity of the coolant pump is preferably determined as a function of a connection degree, for example, of the heater. It is advantageous that the pump is operated corresponding to the demands of the additional device, even if this would not be necessary for cooling of the engine. This is the case, for example, for supplying the heating or cooling of the automatic transmission, for example, during idling. As a result, an additional water pump for the heater may not be required under certain circumstances. Corresponding to a connection degree of the heater, for example, of approximately 100%, the capacity of the coolant pump is increased, so that the latter can pump a portion of the coolant to the heat exchanger of the heater. If no heater is connected, the previously defined capacity of the coolant pump is maintained.

Furthermore, the control system compares a first coolant temperature threshold value with the momentary coolant temperature $T_{Mot}$. If the threshold value is exceeded, the coolant pump is operated at least within a predetermined time interval at a predetermined capacity, so that the engine continues to be cooled. This has an advantage in that the engine is sufficiently cooled when running hot or under additional heating by the ambient temperature.

In order to permit reliable cooling in the case of a hot shut-off of the engine after a high load, it is determined whether the engine is shut off. If, in this case, the coolant temperature exceeds a second coolant temperature threshold value, the coolant pump will be operated at a predetermined capacity within a predetermined time interval, and the engine is cooled. This has the advantage that the engine continues to be cooled, and temperature peaks in the engine after the shut-off of the engine after a high load can therefore be prevented. The duration of after running therefore depends on the temperature exceeding the desired value, in which case a defined duration should not be exceeded (discharge of the battery). When the coolant temperature falls below the second coolant temperature threshold value, no further cooling by the cooling system takes place.

When it is determined that the engine is operative, the control circuit is closed, and another calculation of pump capacity takes place by way of the fed fuel amount in order to achieve continuous cooling of the engine.

An embodiment of the invention will be described in detail with reference to the drawing.

BRIEF DESCRIPTION OF THE DRAWING

The FIGURE is a flow chart of a preferred control method according to the invention.

DETAILED DESCRIPTION OF THE INVENTION

In the control method according to the invention illustrated in the FIGURE, it is first determined whether the engine is operating. In this case, the sum of the fuel quantity since the ignition of the engine $\Sigma m'_{KS}$ is compared with a predetermined desired value $m_{desired}$ of the fuel quantity. In another query, the momentary temperature of the coolant $T_{Mot}$ is compared with a desired temperature $T_{desired}$ of the coolant.

If one of the values falls below the corresponding desired value, that is, if the sum of the fuel since the ignition of the engine is not yet sufficient for heating the engine to the operating temperature or if the engine has not yet reached the required operating temperature, the coolant pump is at first not operated unless by way of a volume flow demanded for other requirements in the cooling system, for example, for a heater. As a result, a discharge of heat from the engine is prevented and a rapid warm-up of the engine is therefore achieved. When one of the desired values is exceeded, the cooling will start. For this purpose, the capacity of the coolant pump is determined as a function of an average value of the fuel quantity at a defined time interval (for example, 30 seconds), of the rotational engine speed and/or of the engine load. Other parameters, such as the operating parameters of the cooling system, are also conceivable.

As mentioned above, the coolant pump can be operated when a volume flow is demanded for other requirements in the cooling system, for example, for a heater. The control of the capacity of the coolant pump as a function of the connected heater has priority over the control as a function of whether there is a falling below or exceeding of the desired values for the fuel quantity or the coolant temperature.

For this purpose, it is determined in another step whether a heater is connected and, as a function thereof, the capacity of the coolant pump is controlled. When a heater is connected, it withdraws heat from the engine since at least a portion of the heated coolant is pumped to the heater and heat is discharged there by way of a heat exchanger to the vehicle interior. As a function of the degree of connection of the heater, the capacity of the coolant pump is controlled correspondingly. If the heater is connected at approximately 100%, the pumping capacity is correspondingly increased to a value of, for example, V'pump=2,200 l/h. If the heater is only connected at 40%, the pumping capacity of the coolant pump is correspondingly lower and amounts, for example, to V'pump=1,500 l/h. If no heater is connected, the previously defined pumping capacity of the coolant pump is kept unchanged. This embodiment of the invention has the particular advantage that, under certain circumstances, no separate pump may be required for the heating circuit. In addition to the heater, or as an alternative, other elements may be used for controlling the coolant pump, which, when they are switched on or connected, withdraw and/or feed heat from or to an engine. In a manner comparable to that of the heater, this can take place by way of the degree of connection or the heat feeding (loss).

In another step, it is determined whether the coolant exceeds a first upper coolant temperature threshold value (for example, 115° C.), for example, as a result of a hot idling. If this is so, and when the pumping capacity of the coolant pump is below a predetermined value sufficient for the cooling, the pumping capacity is increased to this predetermined value and is cooled further within a predetermined time interval. When there is a falling below the threshold value, the capacity of the coolant pump remains unchanged.

In a next step, it is determined whether the engine continues to be in operation. In this case, the control loop closes, as a result of another calculation of the pumping capacity by way of the fed fuel quantity, in order to ensure a continuous cooling of the engine.

If the engine is switched of, it is monitored whether a second lower coolant temperature threshold value (for example, 100° C.) is exceeded by the coolant in order to ensure reliable cooling when the engine is shut off after a high load (hot shut-off). In this case, the coolant pump cools the engine at a predetermined capacity at a predetermined interval of preferably 60–300 seconds. When there is a falling below the second coolant temperature threshold value, no further cooling will take place.

By taking into account special cases, such as the hot shut-off, a cold start without or with the heater as well as the hot idling, it is endeavored to meet the requirements of the heater and of the component temperatures, as well as, by suppressing the forced convection, to minimize the heat transfer and thus achieve a faster component heating. The absolute temperature level of the cooling system continues to be controlled by a thermostat. The latter may be constructed as a conventional thermostat with an expansion material element (heatable as a characteristic diagram thermostat or unbeatable) or as an electric actuator. Preferably, an electrically operated coolant pump is used as the coolant pump and has a separate drive. Cooling water is preferably used as the coolant. All values mentioned here for pumping capacity, temperatures and time intervals are only examples.

The foregoing disclosure has been set forth merely to illustrate the invention and is not intended to be limiting.

Since modifications of the disclosed embodiments incorporating the spirit and substance of the invention may occur to persons skilled in the art, the invention should be construed to include everything within the scope of the appended claims and equivalents thereof.

We claim:

1. A method for controlling a cooling system of an internal-combustion engine comprising controlling a capacity of a coolant pump as a function of a quantity of fuel fed to the internal-combustion engine since ignition of the engine.

2. The method according to claim 1, wherein a desired fuel quantity is defined and compared with a sum of the quantity of fuel fed to the internal-combustion engine since ignition of the engine, no cooling by the coolant pump takes place when the sum falls below the desired fuel quantity, and the coolant pump is operated at an adjustable capacity when the desired fuel quantity is exceeded.

3. The method according to claim 2, wherein the capacity of the coolant pump is determined by at least one of an average value of the quantity of fuel fed to the internal-combustion engine during a predetermined time interval, a rotational engine speed, an engine load, and an outside temperature.

4. The method according to claim 1, wherein the coolant pump is controlled as a function of a temperature of a coolant, a desired temperature of the coolant is defined and compared with the temperature of the coolant, no cooling takes place by the coolant pump when the temperature of the coolant falls below the desired temperature, and the coolant pump is operated at an adjustable capacity when the desired temperature is exceeded.

5. The method according to claim 4, wherein, when the temperature of the coolant exceeds a coolant temperature threshold value of about 115° C., the coolant pump is operated at least within a predetermined time interval at a predetermined capacity of approximately 2,000 l/h.

6. The method according to claim 4, wherein, when the engine is shut off and the coolant temperature exceeds a coolant temperature threshold value of about 100° C., the coolant pump is operated at a predetermined capacity of approximately 1,500 l/h within a predetermined time interval.

7. The method according to claim 1, wherein the coolant pump is controlled as a function of a temperature of engine oil, a desired engine oil temperature is defined and compared with the temperature of the engine oil, no cooling by the coolant pump takes place when the temperature of the engine oil falls below the desired engine oil temperature, and the coolant pump is operated at an adjustable capacity when the desired engine oil temperature is exceeded.

8. The method according to claim 1, wherein the capacity of the coolant pump is controlled as a function of connection of an additional device which can withdraw heat from the internal-combustion engine, feed heat to the internal-combustion engine, or both withdraw heat from and feed heat to the internal-combustion engine, and wherein control of the capacity of the coolant pump has priority.

9. The method according to claim 6, wherein the device is at least one of a heater, an air conditioner, and an automatic transmission.

10. The method according to claim 9, wherein the device is a heater, wherein the capacity of the coolant pump can be adjusted as a function of a degree of connection of the heater, and wherein, at a degree of connection of 100%, the capacity amounts to at least 2,200 l/h.

11. The method according to claim 9, wherein the device is an automatic transmission, and wherein the capacity of the coolant pump can be adjusted as a function of heat feeding of the automatic transmission by adding a pumping capacity to the capacity of the coolant pump required for cooling the internal-combustion engine.

12. A system for controlling a cooling system of an internal-combustion engine having coolant pump comprising a control device which controls a capacity of a the coolant pump as a function of a quantity of fuel fed to the internal-combustion engine since ignition of the engine.

13. The system according to claim 12, wherein the control device controls the coolant pump such that no cooling takes place when a temperature of the coolant falls below a predetermined desired temperature of the coolant, and operates the cooling pump at an adjustable capacity when the desired temperature is exceeded.

14. The system according to claim 13, wherein the control device operates the coolant pump at least within a predetermined time interval at a predetermined capacity when the temperature of the coolant exceeds a coolant temperature threshold value.

15. The system according to claim 13, wherein the control device operates the coolant pump at a predetermined capacity within a predetermined time interval when the engine is shut off and the coolant temperature exceeds a coolant temperature threshold value.

16. The system according to claim 12, wherein the control device controls the coolant pump such that no cooling takes place when a temperature of engine oil falls below a predetermined desired engine oil temperature and operates the coolant pump at an adjustable capacity when the desired engine oil temperature is exceeded.

17. The system according to claim 12, wherein the control device controls the capacity of the coolant pump as a function of connection of an additional device which can withdraw heat from the internal-combustion engine, feed heat to the internal-combustion engine, or both withdraw heat from and feed heat to the internal-combustion engine, and wherein control of the capacity of the coolant pump by the control device has priority.

18. The system according to claim 17, wherein the additional device is at least one of a heater, an air conditioner, and an automatic transmission.

19. The system according to claim 17, wherein the control device controls the capacity of the coolant pump as a function of at least one of a degree of connection and heat feeding of the additional device.

20. The system according to claim 17, wherein the control device controls the capacity of the coolant pump so that it can be switched on for a certain time interval as a function of a degree of connection of the additional device.

21. A system for controlling a cooling system of an internal-combustion engine having a coolant pump comprising a control device which controls a capacity of a coolant pump as a function of a fuel quantity fed to the internal-combustion engine, wherein the control device controls the coolant pump such that no cooling takes place when a sum of the fuel quantity since ignition of the internal-combustion engine falls below a predetermined desired fuel quantity, and operates the coolant pump at an adjustable capacity when the desired fuel quantity is exceeded.

22. The system according to claim 21, wherein the capacity of the coolant pump is determined by at least one of an average value of the fuel quantity during a predetermined time interval, a rotational engine speed, an engine load and an outside temperature.

* * * * *